US009310709B2

(12) United States Patent
Yaguchi

(10) Patent No.: US 9,310,709 B2
(45) Date of Patent: Apr. 12, 2016

(54) IMAGE FORMING APPARATUS INCLUDING CALCULATING PORTION CONFIGURED TO CALCULATE SURFACE POTENTIAL OF IMAGE BEARING MEMBER

(71) Applicant: CANON KABUSHIKI KAISHA, Tokyo (JP)

(72) Inventor: Kazutaka Yaguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/538,222

(22) Filed: Nov. 11, 2014

(65) Prior Publication Data

US 2015/0130886 A1 May 14, 2015

(30) Foreign Application Priority Data

Nov. 12, 2013 (JP) ..... 2013-234274

(51) Int. Cl.

| | |
|---|---|
| ***B41J 2/385*** | (2006.01) |
| ***G03G 15/00*** | (2006.01) |
| ***G03G 15/043*** | (2006.01) |
| ***G03G 15/02*** | (2006.01) |
| ***G03G 15/16*** | (2006.01) |

(52) U.S. Cl.

CPC ..... *G03G 15/043* (2013.01); *G03G 15/0266* (2013.01); *G03G 15/1675* (2013.01)

(58) Field of Classification Search

USPC ..... 347/140, 164, 228, 251, 262, 264; 399/48, 51, 66, 50, 89, 121, 168

See application file for complete search history.

(56) References Cited

U.S. PATENT DOCUMENTS

| | | | | |
|---|---|---|---|---|
| 8,543,021 | B2 | 9/2013 | Sakata et al. | |
| 8,983,317 | B2 * | 3/2015 | Sakata | 399/48 |
| 2010/0040390 | A1 * | 2/2010 | Makino | 399/51 |
| 2011/0255890 | A1 * | 10/2011 | Zaitsu et al. | 399/48 |

FOREIGN PATENT DOCUMENTS

JP 2012-013881 A 1/2012

* cited by examiner

*Primary Examiner* — Stephen Meier

(74) *Attorney, Agent, or Firm* — Fitzpatrick, Cella, Harper & Scinto

(57) ABSTRACT

An image forming apparatus includes: a charging member; a transfer member; a setting portion for setting a positive-side discharge start voltage when a positive-side voltage relative to a reference potential is applied to the transfer member after a voltage is applied to the charging member so that a surface of the image bearing member is charged to the reference potential by the charging member and for setting a negative-side discharge start voltage when a negative-side voltage relative to the reference potential is applied to the transfer member after the voltage is applied; a calculating portion for calculating a correction amount for correcting a light portion surface potential, of the image bearing member, calculated by the calculating portion on the basis of the positive-side and negative-side discharge start voltages; and a correcting portion for correcting the light portion surface potential by using the correction amount.

7 Claims, 9 Drawing Sheets

(a)

(b)

IMAGE FORMING APPARATUS INCLUDING CALCULATING PORTION CONFIGURED TO CALCULATE SURFACE POTENTIAL OF IMAGE BEARING MEMBER

FIELD OF THE INVENTION AND RELATED ART

The present invention relates to an image forming apparatus having a function of detecting a current passing through an image bearing member via a transfer member to detect a light portion surface potential of the image bearing member.

In the image forming apparatus such as a copying machine or a laser beam printer, a contrast of an image is determined by a potential difference between a light portion surface potential (VL) of the image bearing member after laser irradiation, and a developing voltage (Vdc). However, the contrast varies depending on an enrivonment (temperature, humidity) and a (film) thickness of the image bearing member, and therefore there is a need to correct the contrast. In conventional control, the image bearing member potential after the laser irradiation is estimated using a status of use and sensitivity information of the image bearing member, and then correction is made using the estimated image bearing member potential, but the correction is not sufficient in some cases. For that reason, as a system in which the image bearing member potential after the laser irradiation is detected in actuality and then the correction is made with accuracy, a constitution as described in Japanese Laid-Open Patent Application (JP-A) 2012-13881 has been proposed.

In JP-A 2012-13881, positive and negative DC voltages are applied to a charging roller which is a charging member. As a result, a DC voltage applied to the charging roller when electric discharge is started with respect to each of positive and negative polarities of a photosensitive drum which is the image bearing member (hereinafter, this DC voltage is referred to as a discharge start voltage) is discriminated, and then the surface potential of the photosensitive drum is calculated on the basis of each of the discriminated discharge start voltages.

However, in the constitution of JP-A 2012-13881, charging of the photosensitive drum and detection of the photosensitive drum potential after the laser irradiation are carried out by the charging roller. For this reason, the detecting of the photosensitive drum potential cannot be made in a period until the photosensitive drum is rotated one full turn and thus a surface position of the photosensitive drum charged by the charging roller returns to a position of the charging roller again, so that it takes much time to detect the photosensitive drum potential. Further, there is also a system in which the photosensitive drum potential after the laser irradiation is made by a transfer roller which is the transfer member, but in actual use, air bubbles generated in a manufacturing process of the transfer roller and a toner and paper dust deposit on the transfer roller. As a result, unevenness generates on a surface of the transfer roller, so that there is a possibility that an error generates in a detecting result.

SUMMARY OF THE INVENTION

The present invention has been accomplished in view of the above-described circumstances. A principal object of the present invention is to provide an image forming apparatus capable of reducing (improving) a time required for detecting a light portion surface potential of an image bearing member and of forming a high-quality image irrespective of an environment and a change in thickness of the image bearing member.

According to an aspect of the present invention, there is provided an image forming apparatus comprising: a charging member for electrically charging an image bearing member; an exposure portion for exposing the image bearing member to light in order to form a latent image on a surface of the image bearing member; a transfer member for transferring a toner image from the image bearing member onto a sheet; a setting portion for setting a positive-side discharge start voltage when a positive-side voltage relative to a reference potential is applied to the transfer member after a voltage is applied to the charging member so that a surface of the image bearing member is charged to the reference potential by the charging member and for setting a negative-side discharge start voltage when a negative-side voltage relative to the reference potential is applied to the transfer member after the voltage is applied; a calculating portion for calculating a correction amount for correcting a light portion surface potential, of the image bearing member, calculated by the calculating portion on the basis of the positive-side and negative-side discharge start voltages which are set by the setting portion; and a correcting portion for correcting the light portion surface potential of the image bearing member by using the correction amount calculated by the calculating portion.

According to another aspect of the present invention, there is provided an image forming apparatus comprising: a charging member for electrically charging an image bearing member to a predetermined potential; an exposure portion for exposing the image bearing member to light to form a latent image on a surface of the image bearing member; a developing member for forming a toner image by developing the latent image, with a toner, formed on the surface of the image bearing member; a transfer member for transferring the toner image from the image bearing member onto a sheet; a setting portion for setting a positive-side discharge start voltage when a positive-side voltage relative to a reference potential is applied to the transfer member after a voltage is applied to the charging member so that the image bearing member is charged to the reference potential by the charging member and for setting a negative-side discharge start voltage when a negative-side voltage relative to the reference potential is applied to the transfer member after the voltage is applied; a calculating portion for calculating a correction amount for correcting a light portion surface potential, of the image bearing member, calculated by the calculating portion on the basis of the positive-side and negative-side discharge start voltages which are set by the setting portion; and a correcting portion for correcting the light portion surface potential of the image bearing member by subtracting the correction amount calculated by the calculating portion, from the light portion surface potential of the image bearing member, wherein after the image bearing member is exposed to light by the exposure portion after the image bearing member is charged by the charging member so that the light portion surface potential of the image bearing member is a target potential during image formation, ½ of a sum of the positive-side discharge start voltage relative to the target potential and the negative-side discharge start voltage relative to the target potential is obtained as the light portion surface potential of the image bearing member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings.

Embodiment 1

Image Forming Apparatus

Figure 1:
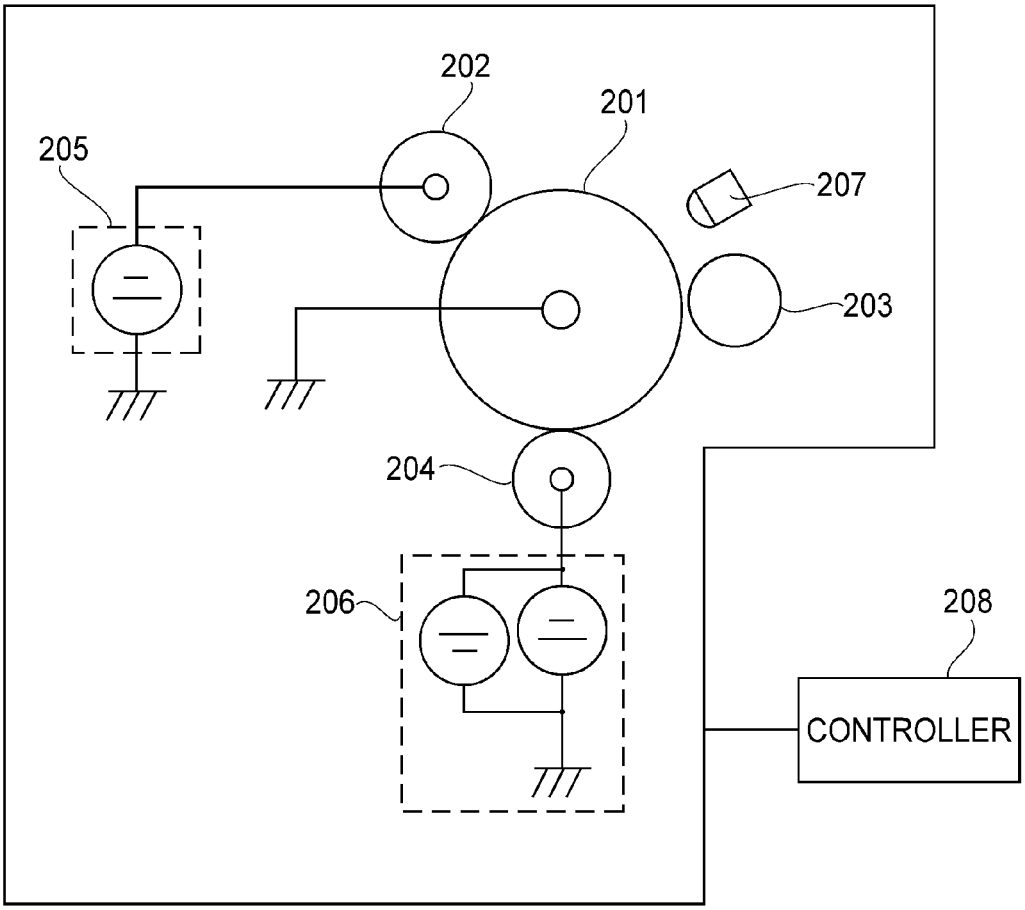
FIG. 1 is a schematic view of an image forming apparatus in Embodiment 1.

FIG. 1 is a schematic view of an image forming apparatus in Embodiment 1. The image forming apparatus includes a photosensitive drum 201, a charging roller 202, a developing sleeve 203, a transfer roller 204, a charging voltage applying circuit 205, a transfer voltage applying circuit 206, a laser light source 207, and a controller 208. The laser light source 207 which is an exposure means makes light exposure for forming an electrostatic latent image by emitting laser light to scan the surface of the photosensitive drum 201, which is an image bearing member, with the laser light. The charging roller 202 which is a charging member electrically charges the surface of the photosensitive drum 201 uniformly. The developing sleeve 203 which is a developing means develops the electrostatic latent image, formed on the photosensitive drum 201, with a toner to form a toner image. The transfer roller 204 which is a transfer member transfers the toner image from the developing sleeve 203 onto a sheet (paper) which is fed and conveyed. A so-called image forming process including the charging of the photosensitive drum 201, the light exposure by the laser light source 207 and the like is controlled by the controller 208 including CPU, ASIC and the like for controlling the image forming apparatus. Drive of the laser light source 207 will be specifically described later with reference to FIG. 7. The image forming apparatus in this embodiment is an example, and therefore the present invention is not limited to this constitution (this embodiment).

The image forming apparatus in this embodiment includes the transfer voltage applying circuit 206 which is a transfer voltage applying means for applying a transfer voltage, which is a DC voltage, to the transfer roller 204 which is the transfer member. The DC voltage is generated by a high-voltage source (power source) 302 ((a) of FIG. 2) which is a constant-voltage source capable of variably changing its value into values of a positive polarity and a negative polarity (positive and negative polarities). The transfer voltage applying circuit 206 includes a current detecting circuit 301 which is a current detecting means for detecting a value of a current passing through the photosensitive drum 201 via the transfer roller 204 during an output of the voltage from the high-voltage source 302. The current value obtained by the current detecting circuit 301 when each of different DC voltages is applied in a non-image area is detected by the controller 208.

The controller 208 discriminates, on the basis of the detected current value, a DC voltage (discharge start voltage) applied from the transfer roller 204 to the photosensitive drum 201 when a current value of the current passing through between the photosensitive drum 201 and the transfer roller 204. Then, the controller 208 calculates a light portion surface potential (photosensitive drum potential) on the photosensitive drum 201 using a discrimination result thereof, and then corrects an error generated in this calculation result. Incidentally, the non-image area is an area, on the photosensitive drum 201, corresponding to a pre-rotation period including raising periods of a motor and the higher-voltage, a post-rotation period including falling periods of the motor and the high-voltage or a period (sheet interval) between images during continuous image formation.

(Transfer Voltage Applying Circuit)

Figure 2:
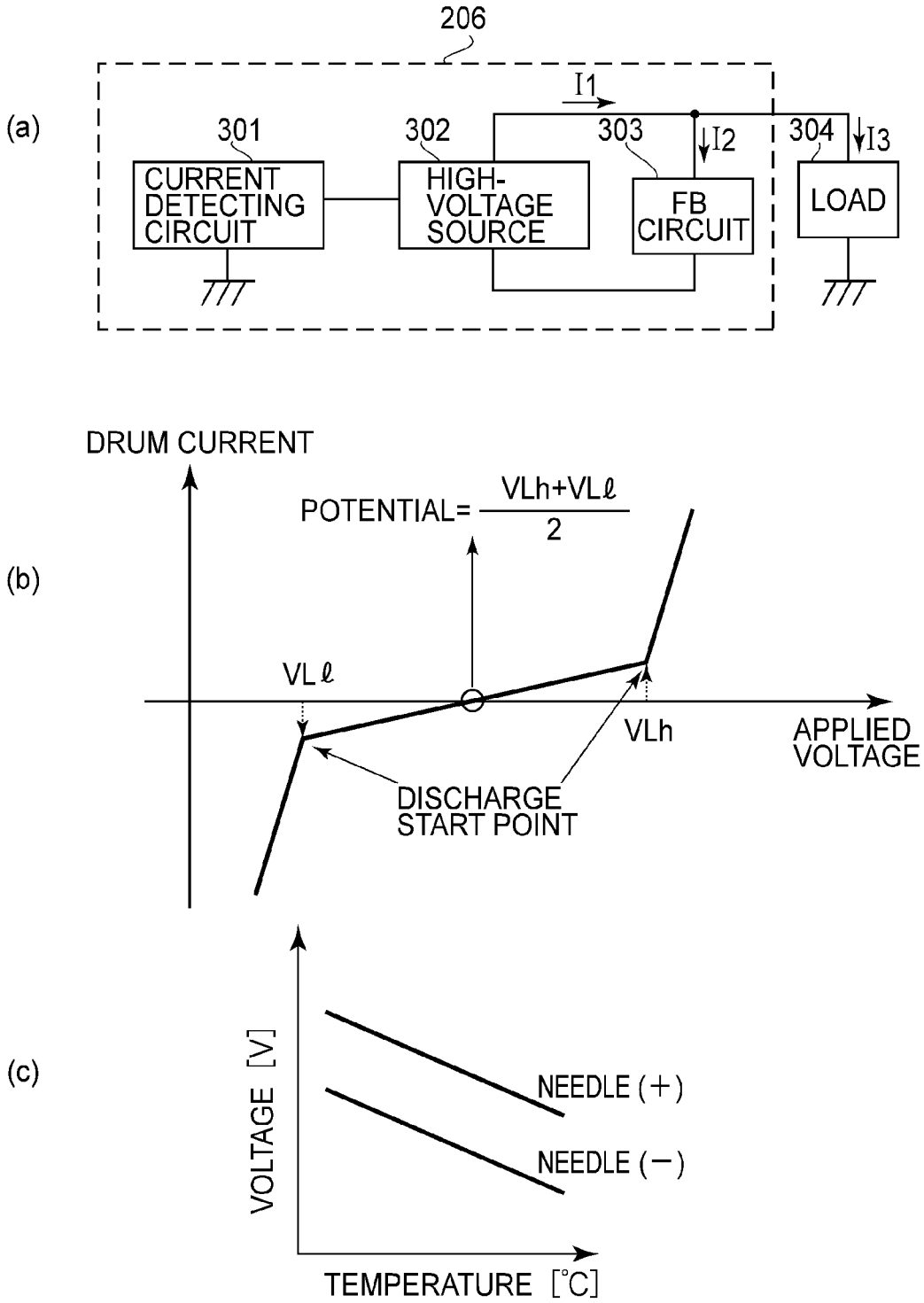
In FIG. 2, (a) is a schematic illustration of a transfer voltage applying circuit, (b) is a graph showing a relationship between an applied voltage t a photosensitive drum and a current characteristic of the photosensitive drum, and (c) is a graph showing a change in discharge start voltage by a polarity effect, in Embodiment 1.

In FIG. 2, (a) is a schematic illustration of the transfer voltage applying circuit 206 in this embodiment. The transfer voltage applying circuit 206 is constituted by the current detecting circuit 301, the high-voltage source 302 and a feedback circuit (FB) circuit 303. The current detecting circuit 301 is a circuit for detecting a current I1 obtained by adding a current I2 flowing from the high-voltage source 302 into the FB circuit 303 and a current I3 flowing from the high-voltage source 302 into a load 304 (formula (1)). The high-voltage source 302 is the constant-voltage source capable of variably generating a positive transfer voltage and a negative transfer voltage. The FB circuit 303 is a circuit provided s that an output voltage from the transfer voltage applying circuit 206 becomes a voltage value determined in advance. The load 304 is the sum of loads from the transfer roller 204 to the ground for the photosensitive drum 201.

$$I1=I2+I3 \quad (1)$$

(Electric Discharge Characteristic of Photosensitive Drum)

As an electric discharge characteristic of the photosensitive drum 201, a potential difference required for electric discharge varies depending on a difference in enrivonment (temperature, humidity) and photosensitive drum thickness. The photosensitive drum thickness decreases with an increase in time of use of the photosensitive drum 201. A surface state of the transfer roller 204 in a situation (enrivonment, photosensitive drum thickness) in which the photosensitive drum 201 is placed in equivalent to a surface state of the photosensitive drum 201, as shown in (b) of FIG. 2, with respect to the photosensitive drum potential, potential differences necessary for start of the electric discharge in positive and negative areas are symmetrical. In FIG. 2, (b) is a graph, in which the abscissa is a voltage applied to the transfer roller 204 and the ordinate is a current passing through the photosensitive drum 201 (hereinafter referred to as a photosensitive drum current), showing a relationship between the applied voltage to the transfer roller 204 and the photosensitive drum current. The above-described surface state of the transfer roller 204 refers to a surface state, described later, in which unevenness is generated due to air bubbles generated in a manufacturing process of the transfer roller 204 and deposition of the toner or the like.

In the case where a gap between the transfer roller 204 and the photosensitive drum 201 is regarded as a gap between two flat surfaces (opposing each other), the electric discharge characteristic is the same as an electric discharge characteristic of the gap between two flat surfaces, so that the photosensitive drum potential can be obtained by a formula (2) shown below. The photosensitive drum potential can be obtained, as shown in (b) f FIG. 2, by ½ of the sum of VLh and VLl where VLh is a voltage (+)-side discharge start voltage relative to the photosensitive drum potential and VLl is a negative (−)-side discharge start voltage relative to the photosensitive drum potential.

$$\text{(Photosensitive drum potential)}=(VLh+VLl)/2 \quad (2)$$

However, in actual use, the air bubbles are generated in the manufacturing process of the transfer roller 204, and paper dust and the toner deposit on the transfer roller 204, so that the unevenness is formed on the surface of the transfer roller 204. In this case, it is known that different from the discharge characteristic in the gap between the flat surfaces, a polarity effect which is an electric discharge phenomenon in a gap between a needle and the flat surface is generated. The needle refers to a projected portion, formed by the generation of the air bubbles in the manufacturing process and by the deposition of the toner and the like on the surface of the transfer roller 204, which is a needle-like projected portion. In FIG. 2, (c) is a graph, in which the abscissa is an ambient temperature (° C.) and the ordinate is the discharge start voltage (V), showing a change in discharge start voltage by the polarity effect. The polarity effect refers to a phenomenon such that the discharge start voltage varies depending on the polarity in a non-uniform electric field in the gap between the needle and the flat surface of the like (i.e., depending on use of a positive power source for outputting the positive transfer voltage or a negative power source for outputting the negative transfer voltage). In this embodiment, as shown in (c) of FIG. 2, in the case of the same temperature, the discharge start voltage ("NEEDLE (+)" in the figure) when the positive transfer voltage is applied to the transfer roller 204 is higher than the discharge start voltage ("NEEDLE (−)" in the figure) when the negative transfer voltage is applied to the transfer roller 204. This is the polarity effect. Further, as shown in (c) of FIG. 4, an absolute value of the discharge start voltage increases with a decreasing temperature.

(Electric Discharge Characteristic Between Photosensitive Drum and Transfer Roller)

Figure 3:
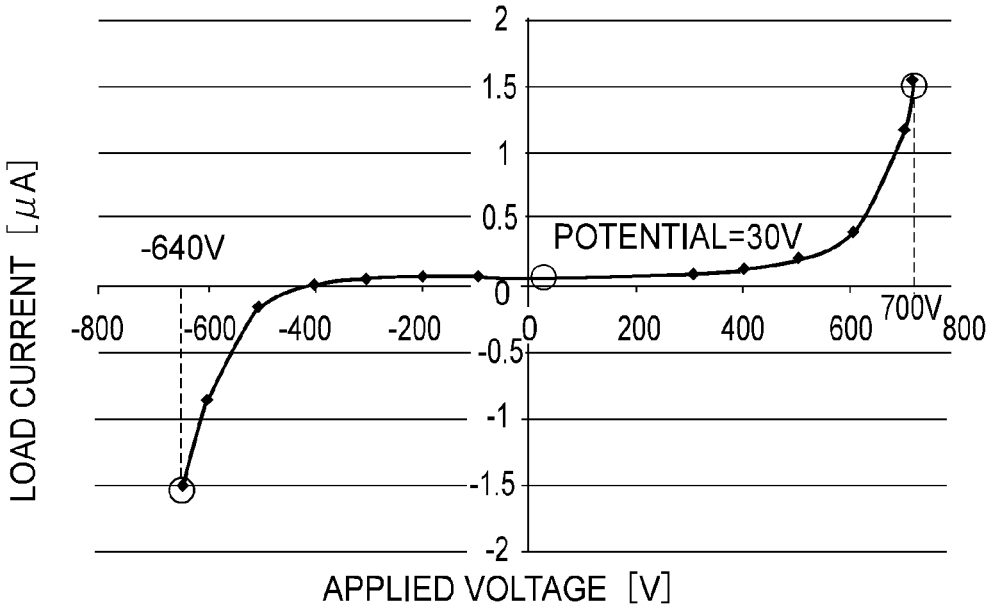
In FIG. 3, (a) and (b) are graphs showing discharge characteristics at different photosensitive drum potentials in Embodiment 1.
Figure 3:
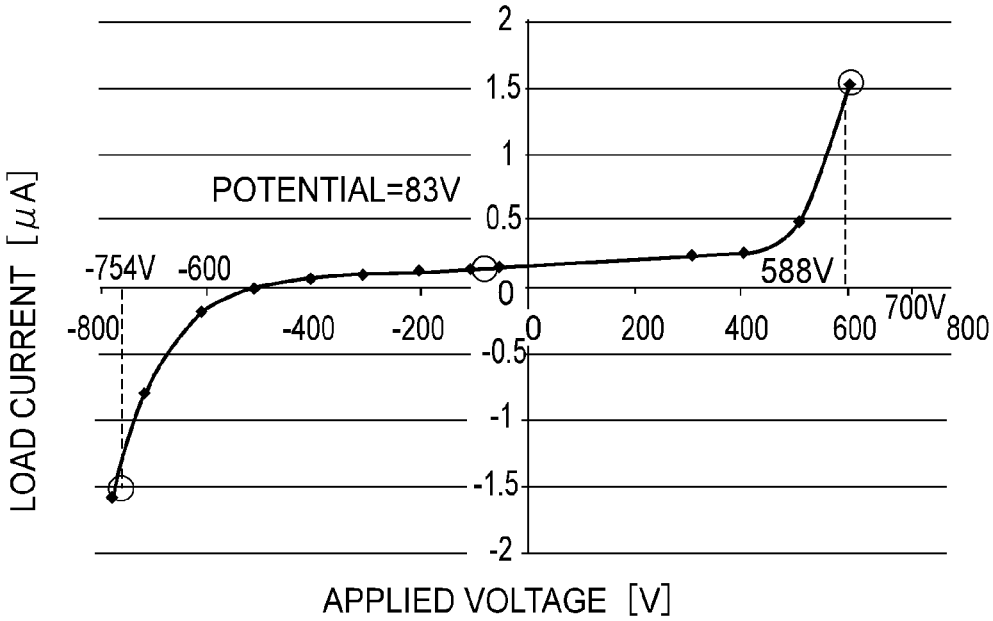

In FIG. 3, each of (a) and (b) shows an example of the discharge characteristic between the photosensitive drum 201 and the transfer roller 204. In (a) and (b) of FIG. 3, the abscissa is the applied voltage (V) to the transfer roller 204, and the ordinate is a load current (μA). When the photosensitive drum 201 is charged at a predetermined reference potential 1 (e.g., 0 V) by the charging roller 202, each of positive and negative transfer voltages is applied to the transfer roller 204. As a result, as shown in (a) of FIG. 3, a positive-side discharge start voltage VLh relative to the reference potential 1 is 700 V, and a negative-side discharge start voltage VLl relative to the reference potential 1 is −640 V. Incidentally, the discharge start voltages VLh and VLl are set somewhat outside bent points (discharge start points in (b) of FIG. 2) of the photosensitive drum potential characteristic curve shown in each of (a) and (b) of FIG. 3. This is because, as described later, a voltage at the time when the discharge phenomenon is stabilized is appropriate as the discharge start voltage. When the photosensitive drum potential is calculated from the respective values of the discharge start voltages VLh and VLl by the formula (2), the following result is obtained.

$$\text{(Photosensitive drum potential)}=(700+(-640))/2=60/2=30\text{(V)}$$

The photosensitive drum 201 is charged to the reference potential 1 (e.g., 0 V) in advance, and therefore, an error in the photosensitive drum potential is 0−30=−30 V.

Similarly, when the photosensitive drum 201 is charged at a predetermined reference potential 2 (e.g., −110 V) by the charging roller 202, each of positive and negative transfer voltages is applied to the transfer roller 204. As a result, as shown in (b) of FIG. 3, a positive-side discharge start voltage VLh relative to the reference potential 2 is 588 V, and a negative-side discharge start voltage VLl relative to the reference potential 2 is −754 V. When the photosensitive drum potential is calculated from the respective values of the discharge start voltages VLh and VLl by the formula (2), the following result is obtained.

$$\text{(Photosensitive drum potential)}=(588+(-754))/2=-166/2=-83\text{(V)}$$

The photosensitive drum 201 is charged to the reference potential 2 (e.g., −110 V) in advance, and therefore, an error in the photosensitive drum potential is −110−(−83)=−27 V. As is apparent from the above results, the errors of the photosensitive drum potentials when the photosensitive drum 201 is charged to predetermined different reference potentials 1 and 2 are −30 V and −27 V, respectively, so that both of the errors substantially coincide with each other. For this reason, it is understood that the error due to the polarity effect in this system is about 30 V (absolute value).

In this embodiment, attention is focused on this point, so that the photosensitive drum 201 is charged to the reference potential f 0 V by applying only an AC voltage from the charging roller 202 which is the charging member, and thereafter the positive and negative transfer voltages are applied to the transfer roller 204. The result obtained by applying VLh and VLl obtained at that time into the formula (2) is used as a correction amount for the above-described error. Further, the photosensitive drum 201 may also be charged to a predetermined reference voltage other than 0 V. In this case, the above-described correction amount is subtracted from a result of calculation, by the formula (2), of the photosensitive drum potential after the laser irradiation (after the light exposure) and before the polarity effect correction. As a result, it is possible to calculate an actual photosensitive drum potential after the laser irradiation, and then on the basis of the calculation result, a laser light quantity value and a high-voltage (voltage) value are set. The laser light quantity value is a value of an exposure amount in which the photosensitive drum 201 is exposed to light.

Further, the polarity effect referred to as the error generated when the surface potential is calculated is an example of the error, and therefore also an error generated due to accuracy of a circuit and an electrical characteristic when the voltage is applied to the photosensitive drum 201 by the transfer roller 204 can be corrected in the constitution of this embodiment. Incidentally, the electrical characteristic is, e.g., a semiconductor characteristic of the photosensitive drum 201. (Manner of obtaining current value (Δ value) for determining discharge start voltage)

Figure 4:
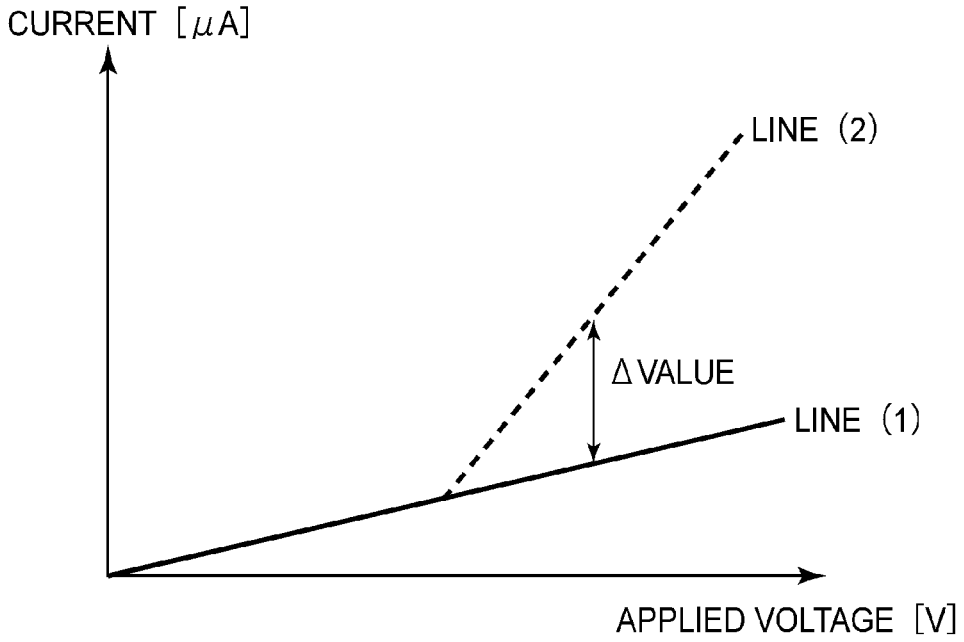
FIG. 4 is a graph showing a relationship between the applied voltage and a current value characteristic in Embodiment 1.

Next, a manner of obtaining a predetermined current value (Δ value) for determining the discharge start voltage will be described. FIG. 4 is a graph in which the abscissa is the applied voltage (V) to the transfer roller 204 and the ordinate is a value (μA) of the current passing through the photosensitive drum 201, and shows a relationship between the applied voltage and the current value in the neighborhood of the discharge start voltage. Until the electric discharge starts between the photosensitive drum 201 and the transfer roller 204, as shown by a rectilinear line (1), a current (dark current) depending on the voltage applied to the transfer roller 204 flows from the transfer roller 204 into the photosensitive drum 201. However, when the electric discharge starts between the photosensitive drum 201 and the transfer roller 204, the current abruptly flows, so that a bent line having a bent point (corresponding to a discharge start point shown in FIG. 5) is obtained as shown by a bent line (2). As a result, an electric discharge current passing through between the photosensitive drum 201 and the transfer roller 204 can be calculated as a Δ value obtained by subtracting a value on the rectilinear line (1) from a value on the bent line (2). Then, a voltage at the time when this Δ value reaches a predetermined current value (e.g., 3 μA or −3 μA) is discriminated as the discharge start voltage. The predetermined current value is a current value at the time when the discharge phenomenon is stabilized, and is a target current voltage I described later.

Figure 5:
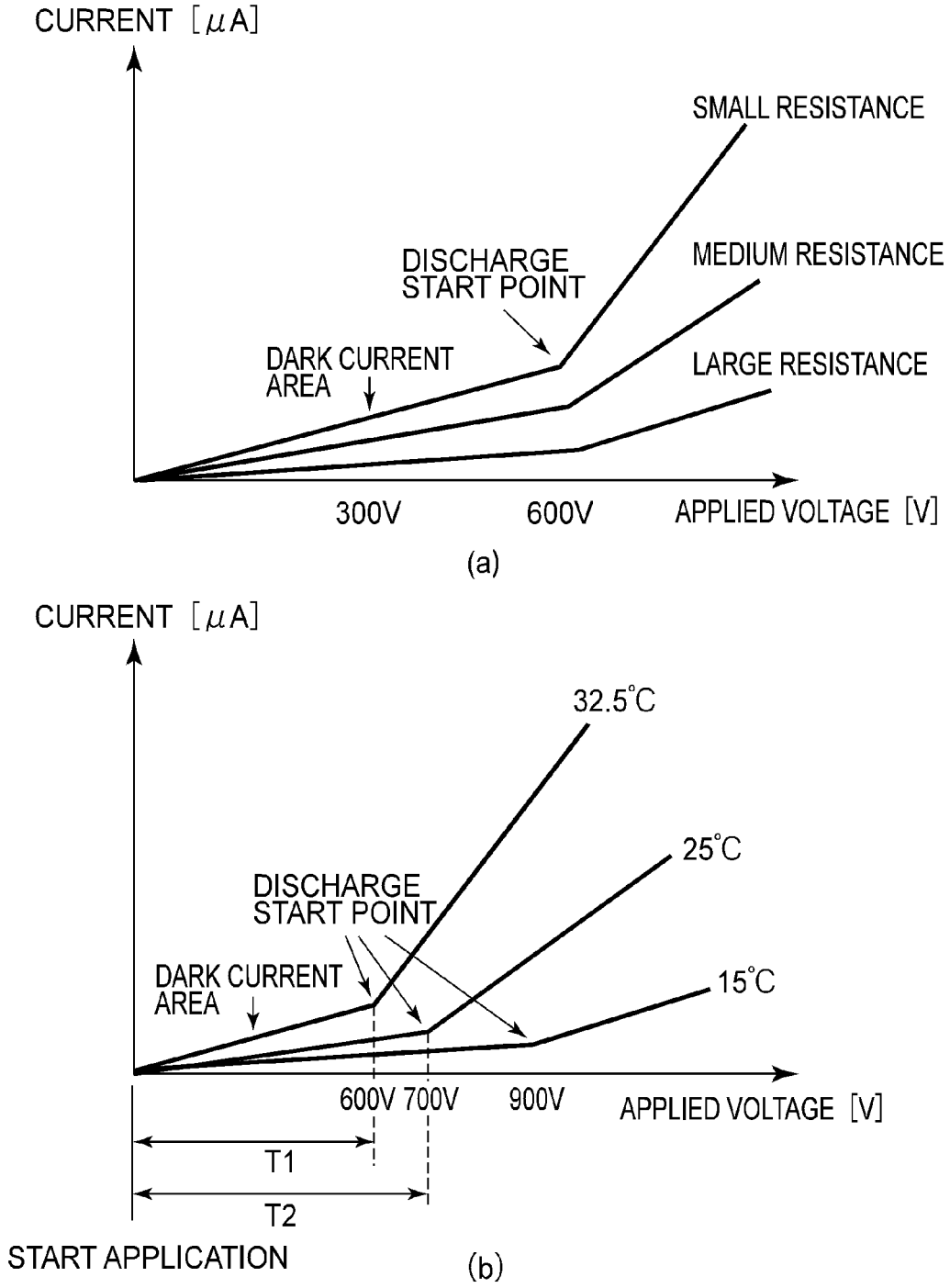
In FIG. 5, (a) is a graph showing a change in current value depending a change in resistance value of a transfer roller, and (b) is a graph showing a change in discharge start voltage depending on a difference in temperature, in Embodiment 1.

Further, the predetermined current value is required to be set depending on a resistance value of the transfer roller 204. When the voltage application to the transfer roller 204 is started, correspondingly thereto the dark current flows from the transfer roller 204 into the photosensitive drum 201 although an amount thereof is small. The dark current changes depending on the resistance value of the transfer roller 204. In FIG. 5, (a) shows a difference in current value depending on a difference in resistance value (e.g., large, medium, small) of the transfer roller 204. In (a) of FIG. 5, the abscissa is the applied voltage (V) to the transfer roller 204 and the ordinate is the value (μA) of the current passing through the photosensitive drum 201, and "DISCHARGE STAT POINT" is the bent point at the time when the Δ (value) is 0 μA or more. As shown in (a) of FIG. 5, the applied voltage reaching the discharge start point increases with an increasing resistance value of the transfer roller 204. A dark current area shown in (a) of FIG. 5 is an area from the applied voltage of 0 V (at the time of voltage application start) until the applied voltage reaches the discharge start point, and in this area, the dark current flows. It can be understood that the value of the dark current varies every resistance value of the transfer roller 204 and has the influence on detection accuracy. For example, the value of the current (including the dark current) flowing from the transfer roller 204 having the small resistance value into the photosensitive drum 201 is larger than the value of the current flowing from the transfer roller 204 having the large resistance value into the photosensitive drum 201. The resistance value of the transfer roller 204 is calculated during calibration before printing, and therefore during the calibration before the printing, it is possible to set the predetermined current value (target current value I) depending on the resistance value of the transfer roller 204.

Further, as described above, it is understood that the discharge start voltage (V) changes depending on a difference in ambient temperature (° C.) from (c) of FIG. 2. For example, with an increasing temperature, the discharge start voltage becomes lower. A difference in discharge start point depending on the difference in temperature is shown in (b) of FIG. 5. In (b) of FIG. 5, the abscissa is the applied voltage (V) to the transfer roller 204, and the ordinate is the value (μA) of the current passing through the photosensitive drum 201. T1 and T2 shown in (b) of FIG. 5 show times from start of the voltage application to the discharge start point at 32.5° C. and 25° C., respectively. As shown in (b) f FIG. 5, when initial applied voltages (voltages at the time of application start) applied to the photosensitive drum 201 in different temperature environments in the same, the times until the discharge start voltages are obtained are different from each other (T1 and T2). That is, with a lower temperature, the time until the electric discharge starts becomes longer. Therefore, in a situation, such as a low-temperature enrivonment, in which an absolute value of the discharge start voltage becomes large (c) of FIG. 2, a time itself of the sequence becomes long. For this reason, the initial applied voltage is variably changed relative to the temperature change by using a temperature sensor or the like as a temperature detecting means, so that the sequence time can also be optimized. This optimization is achieved by changing the initial applied voltage from 0 V to 400 V in the enrivonment of 25° C. in (b) of FIG. 5 to shorten the time until the applied voltage reaches the discharge start point. The discharge start point (substantially equal to the discharge start voltage) is influenced by also a humidity enrivonment, but a degree of the influence is small, and therefore description thereof will be omitted.

(Calculation of Photosensitive Drum Potential after Laser Irradiation)

Next, with reference to (a) of FIG. 6, a series of operations for calculating the photosensitive drum potential VL after the laser irradiation will be described. In <1> of (a) of FIG. 6, the controller 208 charges the photosensitive drum 201 so that the photosensitive drum potential is the reference potential of 0 V by applying a charging AC voltage and a DC voltage f 0 V or only the charging AC voltage from the charging roller 202 to the photosensitive drum 201. In <2> of (a) of FIG. 6, the controller 208 measures a negative-side discharge start voltage VLl(1) relative to the reference potential of 0 V and a positive-side discharge start voltage VLh(1) relative to the reference potential of 0 V by applying positive and negative voltages to the transfer roller 204. In this way, immediately after the photosensitive drum 201 is charged to the reference potential, the measurement of each of the positive-side discharge start voltage and the negative-side discharge start voltage by applying the positive and negative voltages to the transfer roller 204. For this reason, there is no need to wait for start of the measurement of the discharge start voltage until the photosensitive drum 201 rotates one full turn, so that a time required for detecting the photosensitive drum potential can be shortened (improved). Then, in <3> of (a) of FIG. 6, the controller 208 as a calculating means set ½ of the sum of VLl(1) and VLh(1) as a correction amount (formula (3)).

$$(\text{Correction amount})=(VLh(1)+VLl(1))/2 \quad (3)$$

Figure 6:
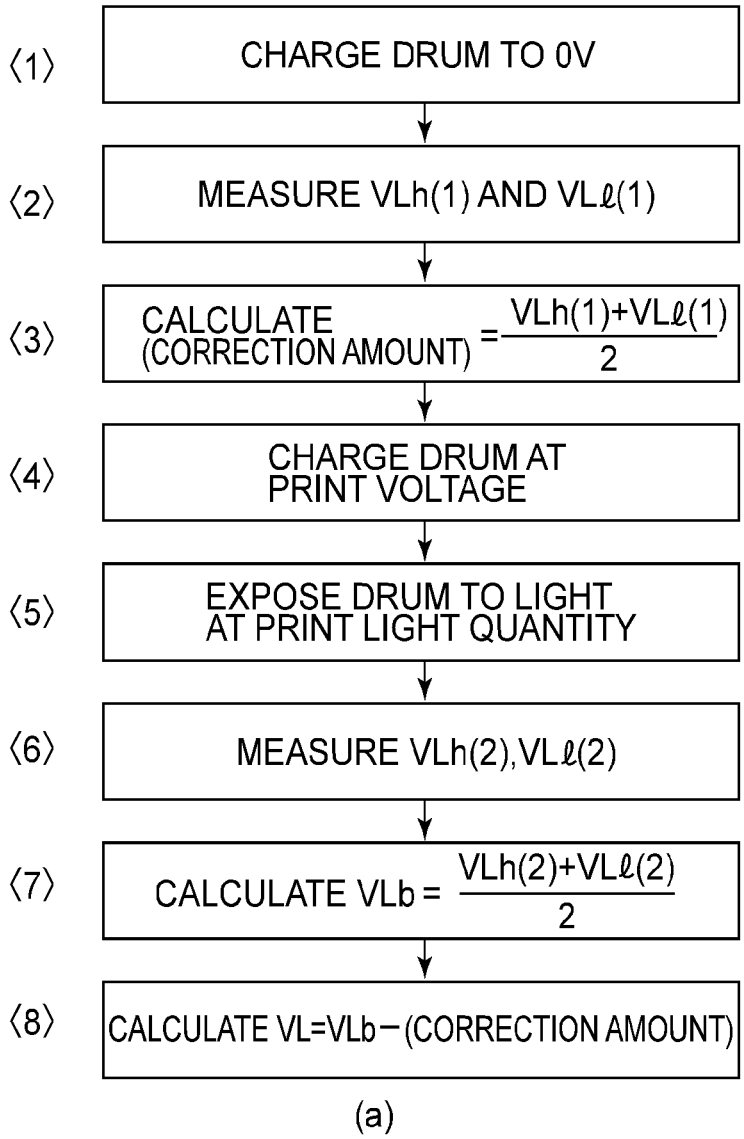
In FIG. 6, (a) is a flowchart showing a series of operations for calculating a photosensitive drum potential VL after laser irradiation, and (b) is a schematic illustration of a laser driving circuit, in Embodiment 1.
Figure 6:
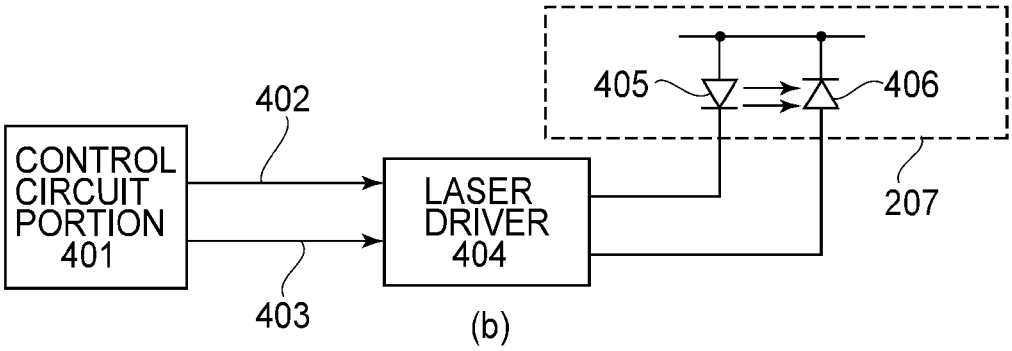

Then, in <4> of (a) of FIG. 6, the controller 208 applies a print voltage (voltage during printing) to the charging roller 202, so that the photosensitive drum 201 is charged by the charging roller 202 to an estimated photosensitive drum potential which is an estimated potential after the laser irradiation. IN<5> of (a) of FIG. 6, the controller 208 irradiates the photosensitive drum 201 with laser light, emitted from the laser light source 207, in a printing light quantity corresponding to a print image. That is, the photosensitive drum 201 is exposed to light in the printing light quantity. In (6) of (a) of FIG. 6, the controller 208 applies, to the transfer roller 204, a voltage including the estimated photosensitive drum potential after the laser irradiation as a center thereof. As a result, the controller 208 as a setting means sets a negative-side discharge start voltage VLl(2) relative to the estimated photosensitive drum potential after the laser irradiation and a positive-side discharge start voltage VLh(2) relative to the estimated photosensitive drum potential after the laser irradiation. Then, in <7> of (a) of FIG. 8, the controller 208 calculated ½ of the sum of VLl(2) and VLh(2) and sets the calculated value as a photosensitive drum potential VLb (formula (4) shown below). The estimated photosensitive drum potential after the laser irradiation is an ideal light portion surface potential of the photosensitive drum 201 when the photosensitive drum 201 is irradiated with the laser light in a predetermined printing light quantity and is, e.g., stored in advance in a memory or the like which is a string means provided in the controller 208. In this memory or the like, in addition to the estimated photosensitive drum potential, various values (data) or the like, used by the controller 208, such as the reference potential and the surface potential of the photosensitive drum 201 are stored.

$$\text{(Photosensitive drum potential } VLb \text{ before polarity effect correction)} = (VLh(2) + VLl(2))/2 \quad (4)$$

This VLb contains an error by the polarity effect. For this reason, in <8> of (a) of FIG. 6, the controller 208 calculates a photosensitive drum potential VL after the laser irradiation by subtracting the correction amount (formula (3)) set in <3> of (a) of FIG. 6 from the photosensitive drum potential VLb before the polarity effect correction.

$$\text{(Photosensitive drum potential } VL \text{ after laser irradiation)} = \text{(Photosensitive drum potential } VLb \text{ before polarity effect correction)} - \text{(Correction amount)} \quad (5)$$

Then, the controller 208 as a correcting means effects control in which a value of a quantity of laser light to be emitted is corrected using the calculated photosensitive drum potential VL. By effecting such control, even when the environment, a photosensitive drum thickness or a surface state of the transfer roller 204 is fluctuated, it becomes possible to obtain a certain potential difference $$\text{((Photosensitive drum potential } VL \text{ after laser irradiation)} - \text{(developing voltage } Vdc\text{))}.$$

(Laser Driving Circuit)

In FIG. 6, (b) is a schematic illustration of a laser driving circuit in this embodiment. The laser driving circuit which is an exposure amount setting means is constituted by a laser driver 404 and a control circuit portion 401. The laser light source 207 driven by the laser driving circuit is constituted by a laser diode 405 and a PD sensor 406. The control circuit portion 401 inputs a video signal (VDO signal) 402, of an image to be printed, into the laser driver 404. The laser driver 404 drives the laser diode 405 in accordance with the video signal 402 inputted from the control circuit portion 401. On the other hand, the laser driver 404 effects control so that emission intensity of the laser light is kept constant while monitoring the laser light emission intensity, emitted from the laser diode 405, by the PD sensor 406. When light quantity changeable signal (PWM (pulse width modulation) signal) 403 is sent from the control circuit portion 401 to the laser driver 404, the laser driver 404 variably changes the light quantity of the laser light, emitted from the laser light source 207, depending on the light quantity changeable signal 403. As a result, the light quantity of the laser light with which the photosensitive drum 201 is irradiated can be variably set. Accordingly, in the case where the photosensitive drum potential VL after the laser irradiation is detected and thereafter a value of the photosensitive drum potential VL is different from a predetermined value, the light quantity of the laser light emitted from the laser light source 207 is changed using the above-described control, so that the value of the photosensitive drum potential VL can be corrected.

(Control by Controller)

Figure 7A:
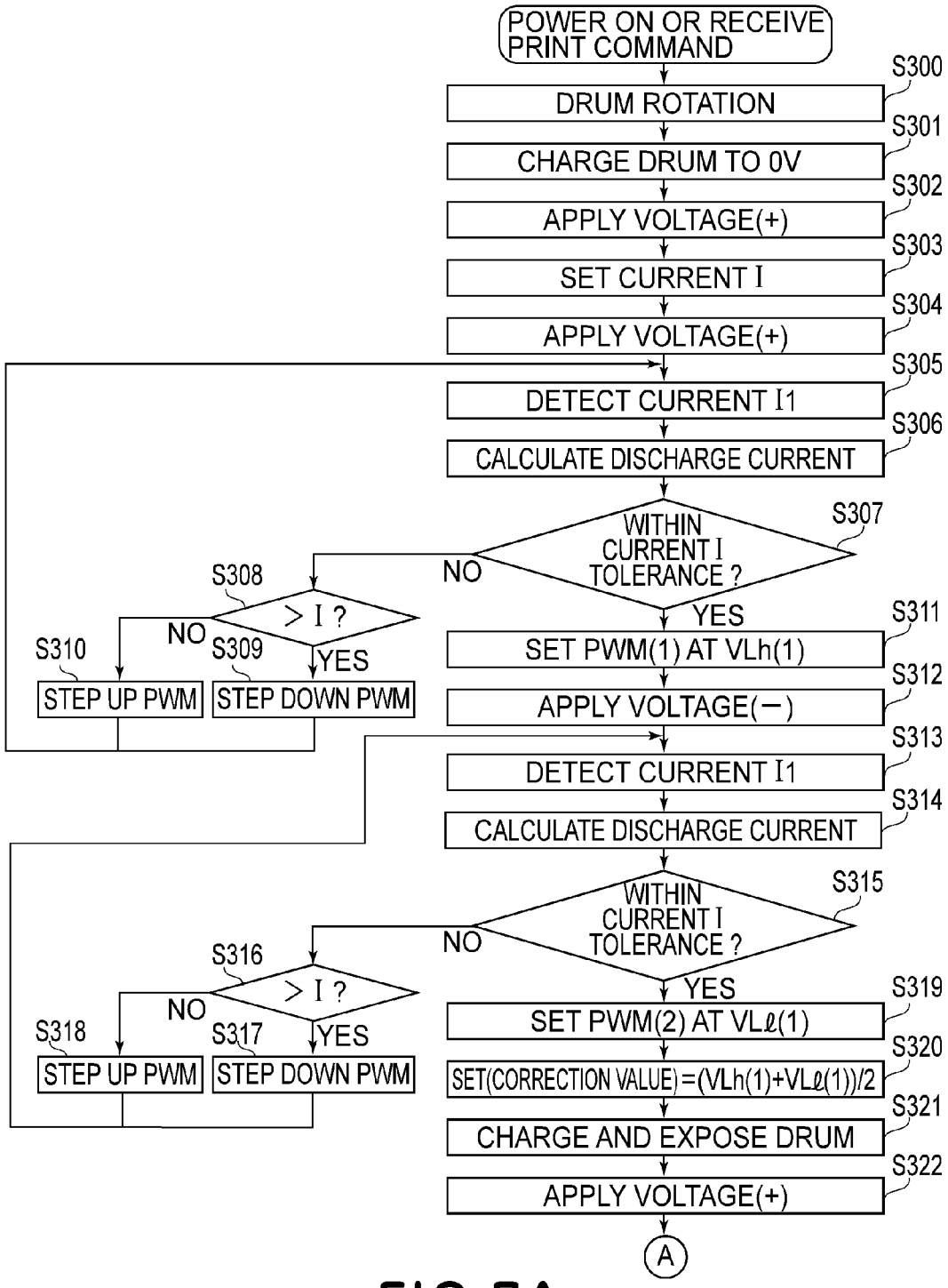
FIG. 7A is a flowchart showing the first half of a principal sequence in Embodiment 1.
Figure 7B:
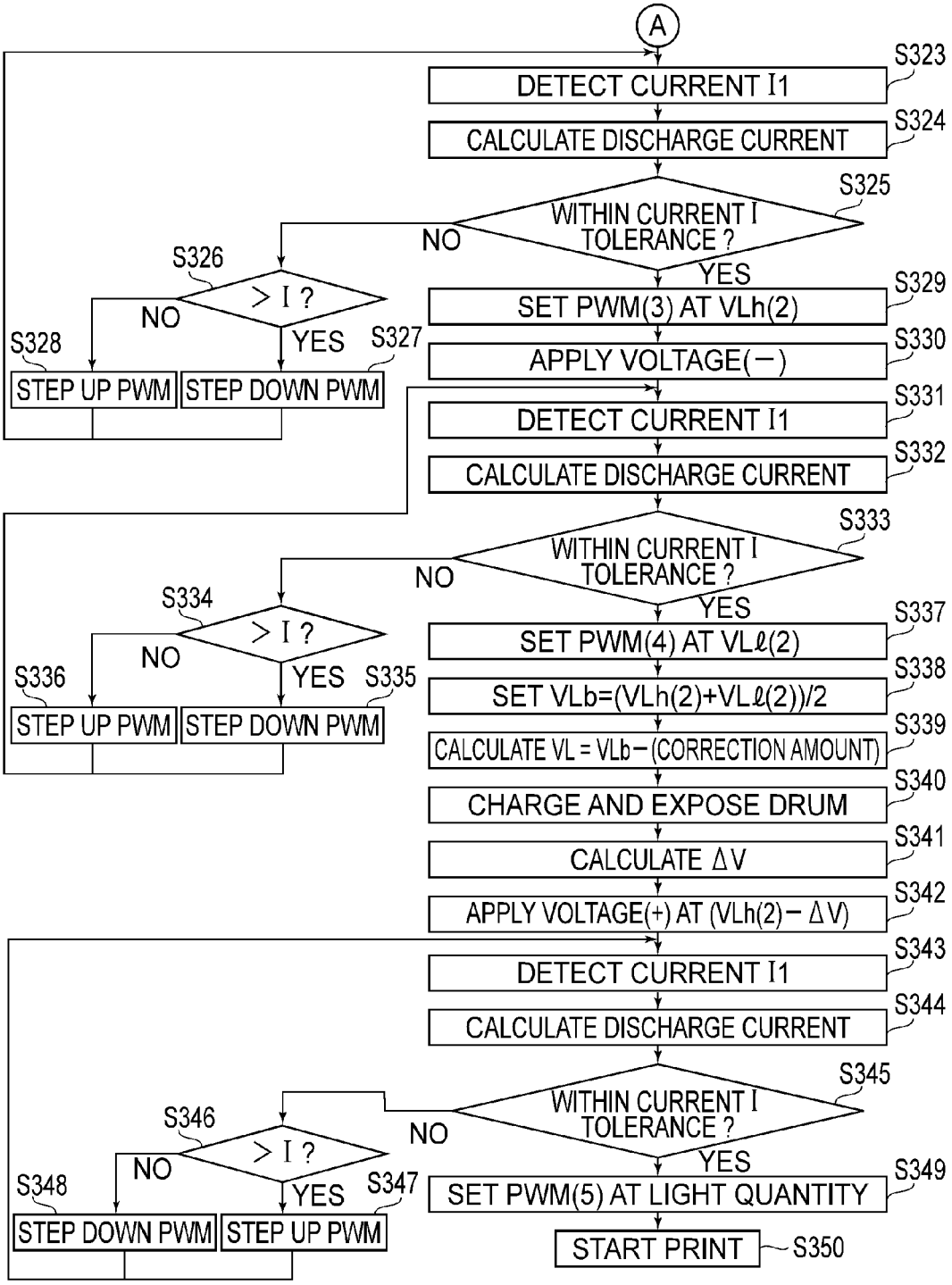
FIG. 7B is a flowchart showing the second half of the principal sequence in Embodiment 1.

FIGS. 7A and 7B are a flowchart showing the control by the controller 208 in this embodiment. Via a circled symbol A, S322 in FIG. 7A is connected to S323 in FIG. 7B. First, after the power of the image forming apparatus is turned on a print command is received, the controller 208 rotates the photosensitive drum 201 in S300 for calibration or the like before start of printing. In S301, the controller 208 causes the correcting roller 202 to charge the photosensitive drum 201 to the reference potential of 0 V in a non-image area of the photosensitive drum 201 by applying only the changing AC voltage to the photosensitive drum 201 by the charging roller 202. Thereafter, in S302, the controller 208 applies a predetermined positive transfer voltage to the transfer roller 204 by the transfer voltage applying circuit 206. In S303, the controller 208 calculates a resistance value of the transfer roller 204 from a current value obtained when the predetermined positive transfer voltage is applied to the transfer roller 204 and an output voltage obtained by the PWM setting, and then sets the above-described target current value I. Then, in S304, the controller 208 applies, to the transfer roller 204, a voltage transfer voltage relative to the reference potential of 0 V by the transfer voltage applying circuit 206. In S305, the controller 208 gradually increases the voltage in the positive side from the reference potential of 0 V by the transfer voltage applying circuit 206. The controller 208 detects, by the current detecting circuit 301, a current I1 which is the sum of a current I3 flowing from the transfer roller 204 into the photosensitive drum 201 and a current I2 flowing from the FB circuit 303 into the FB circuit 303. Then, in S306, the controller 208 calculates an electric discharge current from the current I1.

In S307, the controller 208 compares a calculated value of the discharged current calculated in S306 with the target current value I set in S303, and discriminates whether or not the calculated value of the discharge current is within a tolerance of the target current value I. In the case where the controller 208 discriminates in S307 that the calculated value is not within the tolerance, the controller 208 discriminates in S308 whether or not the calculated value of the discharge current is larger than the target current value I. In the case where the controller 208 discriminates in S308 that the calculated value is larger than the target current value I, an absolute value of the discharge start voltage is set at a lower level, and therefore in S309, the controller 208 steps down the voltage value (PWM value) ("STEP DOWN PWM" in FIG. 7A), and the sequence returns to the process of S305. In the case where the controller 208 discriminates in S308 that the calculated value of the discharge current is smaller than the target current value I, the absolute value of the discharge start voltage is set at a higher level, and therefore in S310, the controller 208 steps up the voltage value (PWM value) ("STEP UP PWM" in FIG. 7A), and the sequence returns to the process of S305. In S307, in the case where the controller 208 as the setting means discriminates that the calculated value is within the tolerance of the target current value I, in S311, the controller 208 sets a voltage value (PWM(1)) at a positive-side discharge start voltage VLh(1) relative to the reference potential of 0 V.

Thereafter, in S312, the controller 208 applies a negative transfer voltage to the transfer roller 204 by the transfer voltage applying circuit 206. In S313, the controller 208 detects, by the current detecting circuit 301, a current I1 which is the sum of a current I3 flowing from the transfer roller 204 and a current I2 flowing from the FB circuit 303. In S314, the controller 208 calculates an electric discharge current from the current I1. Then, in S315, the controller 208 compares a calculated value of the discharged current calculated in S314 with the target current value I set in S303, and discriminates whether or not the calculated value of the discharge current is within a tolerance of the target current value I. In the case where the controller 208 discriminates in S315 that the calculated value is not within the tolerance, the controller 208 discriminates in S316 whether or not the calculated value of the discharge current is larger than the target current value I. In the case where the controller 208 discriminates in S316 that the calculated value is larger than the target current value I, an absolute value of the discharge start voltage is set at a lower level, and therefore in S317, the controller 208 steps down the voltage value (PWM value), and the sequence returns to the process of S313. In the case where the controller 208 discriminates in S316 that the calculated value of the discharge current is smaller than the target current value I, the absolute value of the discharge start voltage is set at a higher level, and therefore in S318, the controller 208 steps up the voltage value (PWM value), and the sequence returns to the process of S313. In S315, in the case where the controller 208 as the setting means discriminates that the calculated value of the discharge current is within the tolerance of the target current value I, in S319, the controller 208 sets a voltage value (PWM(2)) at a negative discharge start voltage VLl(1) relative to the reference potential of 0 V.

Thereafter, in S320, the controller 208 sets ½ of the sum of VLh(1) and VLl(1) at a correction amount.

(Calculation of Photosensitive Drum Potential Before Polarity Effect Correction)

Then, at the photosensitive drum potential after the laser irradiation, the photosensitive drum potential VLb before the polarity effect correction is calculated. In S321, the controller 208 charges the photosensitive drum 201 at the charging voltage value (AC, DC) during the printing and then exposes the photosensitive drum 201 to light at a laser light quantity value during the printing, so that the potential of the photosensitive drum 201 is set at the photosensitive drum potential VL, after the laser irradiation, used in the printing. In S322, the controller 208 applies to the positive transfer voltage to the transfer roller 204 by the transfer voltage applying circuit 206. In S323, the controller 208 detects, by the current detecting circuit 301, a current I1 which is the sum of a current I3 flowing from the transfer roller 204 into the photosensitive drum 201 and a current I2 flowing from the FB circuit 303 into the FB circuit 303. In S324, the controller 208 calculates an electric discharge current from the current I1 detected in S323. In S325, the controller 208 compares a calculated value of the discharged current calculated in S324 with the target current value I set in S303, and discriminates whether or not the calculated value of the discharge current is within a tolerance of the target current value I. In the case where the controller 208 discriminates in S325 that the calculated value is not within the tolerance, the controller 208 discriminates in S326 whether or not the calculated value of the discharge current is larger than the target current value I. In the case where the controller 208 discriminates in S326 that the calculated value is larger than the target current value I, an absolute value of the discharge start voltage is set at a lower level, and therefore in S327, the controller 208 steps down the voltage value (PWM value), and the sequence returns to the process of S323. In the case where the controller 208 discriminates in S326 that the calculated value of the discharge current is smaller than the target current value I, the absolute value of the discharge start voltage is set at a higher level, and therefore in S328, the controller 208 steps up the voltage value (PWM value), and the sequence returns to the process of S323. In S325, in the case where the controller 208 discriminates that the calculated value of the discharge current is within the tolerance of the target current value I, in S329, the controller 208 sets a voltage value (PWM(3)), at that time, at a positive-side discharge start voltage VLh(2) relative to the estimated photosensitive drum potential VL after the laser irradiation. In S330, the controller 208 applies a negative transfer voltage to the transfer roller 204 by the transfer voltage applying circuit 206. In S331, the controller 208 detects, by the current detecting circuit 301, a current I1 which is the sum of a current I3 flowing from the transfer roller 204 at that time and a current I2 flowing from the FB circuit 303 at that time. In S332, the controller 208 calculates an electric discharge current from the current I1. Then, in S333, the controller 208 compares a calculated value of the discharged current calculated in S332 with the target current value I set in S303, and discriminates whether or not the calculated value of the discharge current is within a tolerance of the target current value I. In the case where the controller 208 discriminates in S333 that the calculated value is not within the tolerance, the controller 208 discriminates in S334 whether or not the calculated value of the discharge current is larger than the target current value I. In the case where the controller 208 discriminates in S334 that the calculated value is larger than the target current value I, an absolute value of the discharge start voltage is set at a lower level, and therefore in S335, the controller 208 steps down the voltage value (PWM value), and the sequence returns to the process of S331. In the case where the controller 208 discriminates in S334 that the calculated value of the discharge current is smaller than the target current value I, the absolute value of the discharge start voltage is set at a higher level, and therefore in S336, the controller 208 steps up the voltage value (PWM value), and the sequence returns to the process of S331. In S333, in the case where the controller 208 as the setting means discriminates that the calculated value of the discharge current is within the tolerance of the target current value I, in S337, the controller 208 sets a voltage value (PWM (4)) at a negative discharge start voltage VLl(2) relative to the estimated photosensitive drum potential VL after the laser irradiation.

Thereafter, in S338, the controller 208 sets ½ of the sum of VLh(2) and VLl(2) at a the photosensitive drum potential VLb before the polarity effect correction. In S339, the controller calculates the photosensitive drum potential VL after the laser irradiation by subtracting the correction amount set in S320 from the photosensitive drum potential VLb before the polarity effect correction set in S338.

(Setting of Laser Light Quantity Value)

Next, S340 and the later are a sequence for setting the laser light quantity value by using the calculated photosensitive drum potential VL after the laser irradiation.

In S340, the controller 208 charges the photosensitive drum 201 at the charging voltage value (AC, DC) during the printing and then exposes the photosensitive drum 201 to light at a laser light quantity value during the printing, so that the potential of the photosensitive drum 201 is set at the photosensitive drum potential VL, after the laser irradiation, used in the printing. In S341, the controller 208 calculates a difference ΔV (VL−VLdl) between the photosensitive drum potential VL, after the laser irradiation, calculated in S339 and a photosensitive drum potential VLdl optimum during the printing. The photosensitive drum potential VLdl is set in advance as an ideal value, and is stored in advance in, e.g., the memory or the like provided in the controller 208. In S342, the controller 208 applies to the positive transfer voltage to the transfer roller 204 by the transfer voltage applying circuit 206 at a value obtained by subtracting the difference ΔV calculated in S341 from VLh(2) set in S329. Then, in S343, the controller 208 detects, by the current detecting circuit 301, a current I1 which is the sum of a current value of a current I3 flowing from the transfer roller 204 into the photosensitive drum 201 and a current value of a current I2 flowing from the FB circuit 303 into the FB circuit 303. In S344, the controller 208 calculates an electric discharge current from a detected value of the current I1 based on a theory shown in (Manner of obtaining current value (Δ value) for determining discharge start voltage) described above.

In S345, the controller 208 compares a calculated value of the discharged current with the target current value I, and discriminates whether or not the calculated value of the discharge current is within a tolerance of the target current value I. In the case where the controller 208 discriminates in S345 that the calculated value is not within the tolerance, the controller 208 discriminates in S346 whether or not the calculated value of the discharge current is larger than the target current value I. In the case where the controller 208 discriminates in S346 that the calculated value is larger than the target current value I, a value of (VLh(2)−ΔV) and the discharge start voltage do not coincide with each other, and thus the photosensitive drum potential VLdl optimum during the printing is not obtained. Therefore in S347, the controller 208 steps up the laser light quantity value (PWM value) to increase the light quantity of the laser light emitted from the laser light source 207, and the sequence returns to the process of S343. In the case where the controller 208 discriminates in S346 that the calculated value of the discharge current is smaller than the target current value I, the value of (VLh(2)−ΔV) and the discharge start voltage do not coincide with each other, and thus the photosensitive drum potential VLdl optimum driving the printing is not obtained. Therefore in S348, the controller 208 steps down the laser light quantity value (PWM value) to decrease the light quantity of the laser light emitted from the laser light source 207, and the sequence returns to the process of S343. In S345, in the case where the controller 208 discriminates that the calculated value of the discharge current is within the tolerance of the target current value I, in S349, the controller 208 sets a laser light quantity value (PWM(5)), at that time, at a predetermined laser light quantity value. The controller 208 performs the sequence described above, so that the voltage of (photosensitive drum potential VL)−(developing voltage Vdc) is controlled at a predetermined value. After the setting of these values is completed, in S350, the controller 208 starts the printing.

According to Embodiment 1 described above, it is possible to not only improve (decrease) the time required for detecting the surface potential of the image bearing member but also form a high-quality image without being influenced by changes in the environment and the thickness of the image bearing member.

Embodiment 2

An image forming apparatus in Embodiment 2 includes, similarly as in Embodiment 1, the transfer voltage applying circuit 206 for applying the transfer voltage, which is the DC voltage, to the transfer roller 204. Further, the DC voltage is generated by the constant-voltage source capable of changing the voltage to those of positive and negative polarities, and the current detecting circuit 301 for detecting the value of the current passing through the photosensitive drum 201 via the transfer roller 204 during output of the constant-voltage source is provided. The image forming apparatus sets respective discharge start voltages on the basis of respective current values detected by the current detecting circuit 301 when different DC voltages are applied in a non-image area. Then, the controller 208 calculates the surface potential of the photosensitive drum 201 by using the set discharge start voltage, and then corrects an error generated in this calculation result. Further, the controller 208 as a developing voltage setting means sets a developing value on the basis of a result after the correction.

A difference of this embodiment from Embodiment 1 is that the voltage difference of VL−Vdc can be variably obtained using the value of the developing voltage Vdc, and therefore a laser light quantity changing function may be not required to be used.

Schematic constitutions of the image forming apparatus and the transfer voltage applying circuit in this embodiment are the same as those in Embodiment 1, and therefore will be omitted from description.

Figure 8:
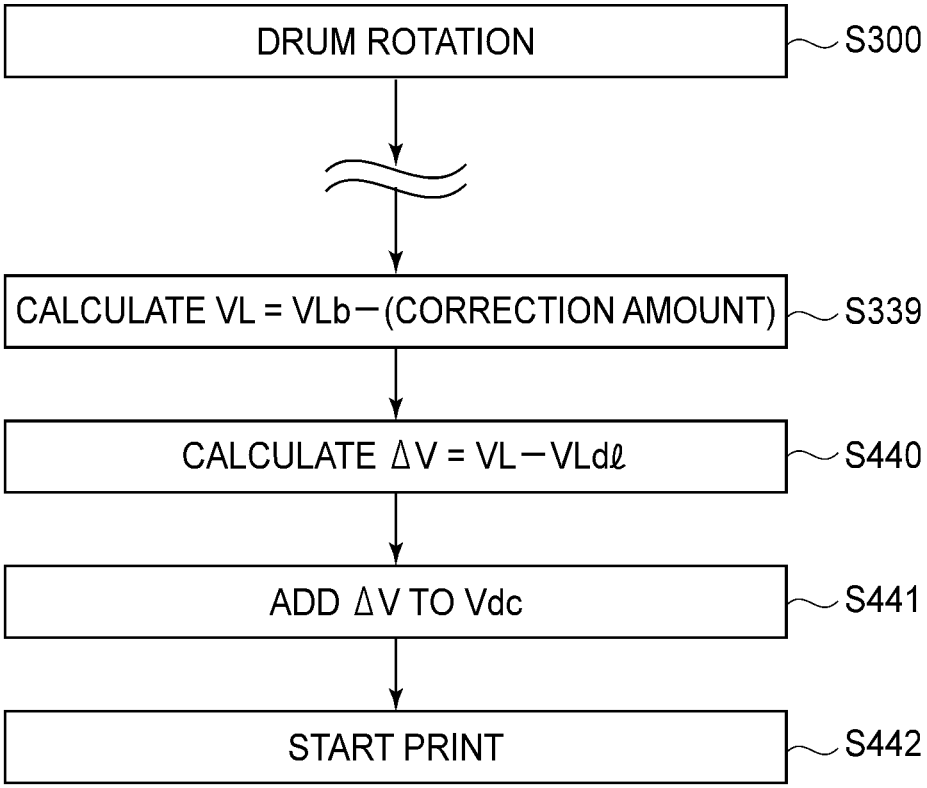
FIG. 8 is a flowchart showing a principal sequence in Embodiment 2.

The controller 208 in this embodiment effects control in accordance with a flowchart shown in FIG. 8. The flowchart shown in FIG. 8 is a sequence for setting the value of the developing voltage Vdc by using the calculated photosensitive drum potential VL after the laser irradiation. In the flowchart of FIG. 8, S300 to S339 are similar to those in Embodiment 1, and therefore will be omitted from description, and only S300 and S339 are shown in FIG. 8. In S440 subsequent to S339, the controller 208 calculates the difference ΔV (VL−VLdl) between the photosensitive drum potential VL after the laser irradiation calculated in S339 and the photosensitive drum potential VLdl optimum during the printing. In S441, the controller 208 add ΔV to the developing voltage value during the printing (Vdc+ΔV), thus correcting the developing voltage value. The controller 208 as the developing voltage setting means sets the developing voltage value (PWM (6)), at that time, at a predetermined developing voltage value. The controller 208 performs the sequence described above, so that the voltage of (photosensitive drum potential VL)−(developing voltage Vdc) is controlled at a predetermined value, and then, in S442, the controller 208 starts the printing.

According to Embodiment 2 described above, it is possible to not only improve (decrease) the time required for detecting the surface potential of the image bearing member but also form a high-quality image without being influenced by changes in the environment and the thickness of the image bearing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 234274/2013 filed Nov. 12, 2013, which is hereby incorporated by reference.

What is claimed is:

1. An image forming apparatus comprising:

an image bearing member configured to bear an image;

a charging member configured to charge said an image bearing member;

an exposure portion configured to expose the image bearing member to light in order to form a latent image on a surface of the image bearing member;

a developing member configured to form a toner image by developing the latent image, with a toner, formed on the surface of the image bearing member;

a transfer member configured to transfer the toner image from the image bearing member onto a sheet;

a current detecting portion configured to detect a current value of a current flowing between said transfer member and said image bearing member when a voltage is applied to said transfer member;

a controller configured to discriminate, as a first discharge start voltage, a voltage applied to said transfer member when the current value detected by said current detecting portion under application of a positive voltage relative to a reference potential to said transfer member after the surface of said image bearing member is charged to the reference potential by said charging member reaches a predetermined value, and configured to discriminate, as a second discharge start voltage, a voltage applied to said transfer member when the current value detected by said current detecting portion under application of a negative voltage relative to the reference potential to said transfer member reaches the predetermined value; and a calculating portion configured to calculate, as a correction voltage, ½ of a sum of the first discharge start voltage and the second discharge start voltage, wherein said controller discriminates, as a third discharge start voltage, a voltage applied to said transfer member when the current value detected by said current detecting portion under application of a positive voltage to said transfer member relative to an exposed portion potential after the surface of said image bearing member is charged to a predetermined potential so as to be a target potential during image formation by said charging member and then the surface of said image bearing member is exposed to light by said exposure portion with an exposure amount during the image formation reaching a predetermined value, and discriminates, as a fourth discharge start voltage, a voltage applied to said transfer member when the current value detected by said current detecting portion under application of a negative-side voltage relative to the exposed portion potential to said transfer member reaches the predetermined value, said calculating portion calculates ½ of a sum of the third discharge start voltage and the fourth discharge start voltage as a surface potential of said image bearing member after the surface of said image bearing member is exposed to light by said exposure portion, and said controller sets an image forming condition on the basis of a result obtained by subtracting the correction voltage from the calculated surface potential.

2. An image forming apparatus according to claim 1, further comprises a storing portion configured to store a result obtained by subtracting the correction voltage from the surface potential by said calculating portion.

3. An image forming apparatus according to claim 1, further comprising an exposure amount setting portion configured to set an exposure amount in which the image bearing member is exposed to light by said exposure portion so that the light portion surface potential of the image bearing member after the image bearing member is exposed to light by said exposure portion is a predetermined light portion surface potential, of the image bearing member, set in advance.

4. An image forming apparatus according to claim 1, further comprising a developing voltage setting portion for setting a developing voltage value as a predetermined developing voltage value so that a voltage between the light portion surface potential of the image bearing member and a developing voltage is a predetermined value, wherein the developing voltage value is obtained by calculating a difference between the exposed portion potential obtained by said calculating portion and the light portion surface potential of the image bearing member set in advance and then by adding the difference to a value of the developing voltage to be applied to said developing member.

5. An image forming apparatus according to claim 1, wherein the predetermined value is set depending on a resistance value of said transfer member.

6. An image forming apparatus according to claim 1, further comprising a temperature detecting portion configured to detect an ambient temperature, wherein an initial applied voltage when the voltage application to said transfer member is started is changed depending on the temperature detected by said temperature detecting portion.

7. An image forming apparatus according to claim 1, wherein the correction voltage is a voltage for correcting a fluctuation of a discharge start voltage corresponding to a change in resistance value of said transfer member.

* * * * *